United States Patent [19]

Haycock

[11] Patent Number: 4,469,031

[45] Date of Patent: Sep. 4, 1984

[54] SUPPORT ASSEMBLY

[75] Inventor: Ivan J. Haycock, St. Albans, England

[73] Assignee: Leida Systems Limited, Bedfordshire, England

[21] Appl. No.: 353,005

[22] Filed: Feb. 26, 1982

[30] Foreign Application Priority Data

Jan. 19, 1981 [GB] United Kingdom ..... 8201392
Feb. 27, 1981 [GB] United Kingdom ..... 8106382

[51] Int. Cl.[3] ..... A47B 9/00

[52] U.S. Cl. ..... 108/144; 248/218.4; 248/243; 108/108

[58] Field of Search ..... 108/144, 108; 248/315, 248/302, 219.2, 243, 249, 221.4, 220.2; 211/187

[56] References Cited

U.S. PATENT DOCUMENTS

| | | | |
|---|---|---|---|
| 1,324,537 | 12/1919 | Belcher | 108/108 |
| 1,765,644 | 6/1930 | Aukenthaler . | |
| 2,872,144 | 2/1959 | Hobson | 248/218.4 X |
| 3,002,723 | 10/1961 | Daum | 248/315 |
| 3,279,620 | 10/1966 | Nesbitt | 248/302 X |
| 3,321,167 | 5/1967 | Doerr | 248/243 |
| 4,015,809 | 4/1977 | Buril | 248/218.4 X |
| 4,194,637 | 3/1980 | Edson | 248/221.4 X |

FOREIGN PATENT DOCUMENTS

| | | | |
|---|---|---|---|
| 719736 | 2/1932 | France | 108/108 |
| 1084863 | of 0000 | United Kingdom . | |
| 1252412 | 11/1971 | United Kingdom | 248/218.4 |

*Primary Examiner*—William E. Lyddane
*Assistant Examiner*—Peter A. Aschenibrenner
*Attorney, Agent, or Firm*—Cushman, Darby & Cushman

[57] ABSTRACT

A support assembly is disclosed comprising an elongate member and a bracket.

In order to fix the bracket to the elongate member in such a way that it cannot easily be dislodged from the member accidentally, the member is provided with a longitudinal channel and one or more intersecting transverse channels, and the bracket is provided with an angled element which lies in the channels at an intersection, and means (preferably a further angled element engaged in the intersection of a further longitudinal channel and transverse channel) to embrace the member to hold the angled element in the channels. Bracket extensions may be fitted to the brackets supporting shelving, cabinets, cupboards and the like.

34 Claims, 10 Drawing Figures

FIG. 5.
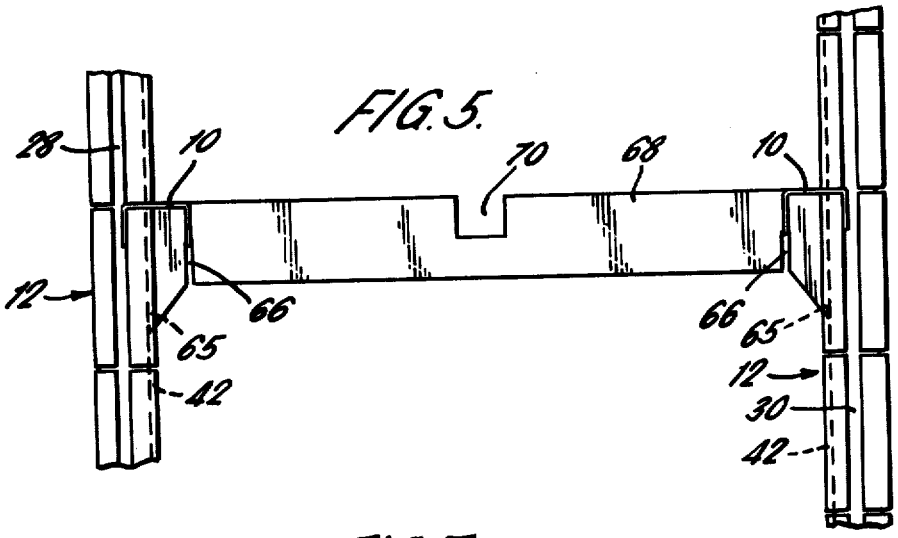
FIG. 7.
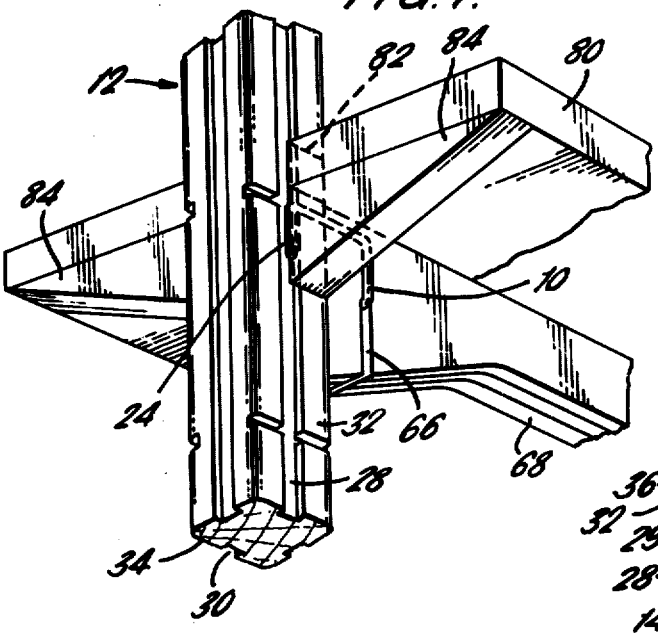
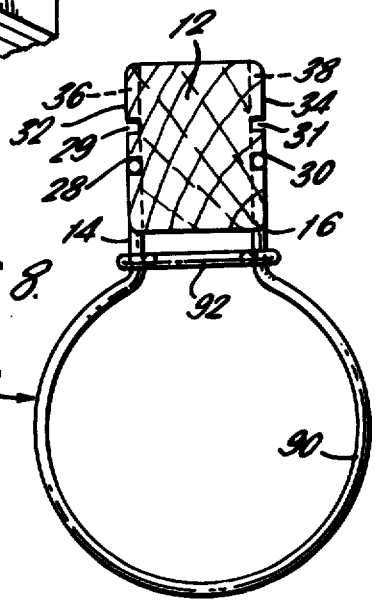
FIG. 8.

SUPPORT ASSEMBLY

BACKGROUND OF THE INVENTION

1. Field of the Invention

This invention relates to support assemblies and particularly, but not exclusively, to support assemblies which can be used for supporting, for example, shelving, cabinets, cupboards and the like, or which can be used in the construction of tables.

2. Description of the Prior Art

Support assemblies have been disclosed in the following United Kingdom Patent Specifications: No. 323638 (Mieville) and its patent of addition No. 328108 (Mieville), No. 364161 (Sayer et al) and No. 780543 (Courteau).

In Nos. 323638 and 328108, an elongate support member is formed so as to have a longitudinal channel facing in one direction and at least one transverse channel intersecting and falling at right angles to the longitudinal channel. A bent-wire bracket lies in both channels engaging also the support member in a further longitudinal channel opposite the first longitudinal channel and is held in position under the weight of the bracket. A disadvantage of this construction is that if the bracket is pushed or knocked upwardly, the bracket can become dislodged from the longitudinal channels and twist on or fall from the support member.

In No. 364161, an elongate support member has a pair of longitudinal channels in opposed faces thereof and at least one inclined hole extending through the member from one channel to the other. A bent wire bracket is shaped so that it extends along one of the channels, through the hole and into the other channel. Again the bracket is held in place under its own weight, and if the bracket is pushed or knocked upwardly it can become dislodged from the support member.

In No. 780543, an elongate support member has a pair of longitudinal channels facing at right angles to each other, one of the channels being formed with a series of holes in the bottom of the other channel. A zig-zag shaped member fits into one of the holes so that it projects from the channel. A shelf has a cut-out to receive the support member and rests on the projecting part of the zig-zag member. The shelf is provided with a projection to fit the other longitudinal channel and a further projection to engage one side of the zig-zag member to hold the first projection in said other longitudinal channel. The shelf rests on the zig-zag member under its own weight, and can be pushed or knocked upwardly, whereupon the projections can become dislodged from the channel or zig-zag member and the assembly may collapse.

SUMMARY OF THE INVENTION

An object of the present invention is to provide a support assembly of an elongate member and a bracket in which the bracket cannot be easily dislodged from the member accidentally.

A further object of the present invention is to provide such a support assembly which does not rely on the weight of the bracket to hold the bracket on the member.

In accordance with the present invention, there is provided a support assembly comprising an elongate member, the elongate member having a longitudinal facet, a longitudinal channel extending along the facet of the elongate member and one or more transverse channels extending across the facet and intersecting the longitudinal channel, and a bracket, the bracket having an angled element engageable in the longitudinal channel and the or any one of the transverse channels at an intersection, and means to embrace the elongate member to hold the angled element in engagement with the longitudinal channel and that transverse channel.

A further objection of a preferred embodiment of the invention is to provide such a support assembly in which the bracket can be easily fitted to the elongate member without the need for tools. To this end, the bracket may be formed from a rod which is resilient so that the angled element can be resiliently deformed to permit engagement with and disengagement from the channels of the elongate member.

BRIEF DESCRIPTION OF THE DRAWINGS

FIG. 5 is an elevation of a support assembly using bracket assemblies according to the invention;

FIG. 7 is a perspective view from below of a shelf supported on a support assembly of the type shown in FIG. 5; and FIG. 8 is an end view of modified support assembly, according to the invention for holding a flower-pot tray;

DETAILED DESCRIPTION OF THE DRAWINGS

Figure 1:
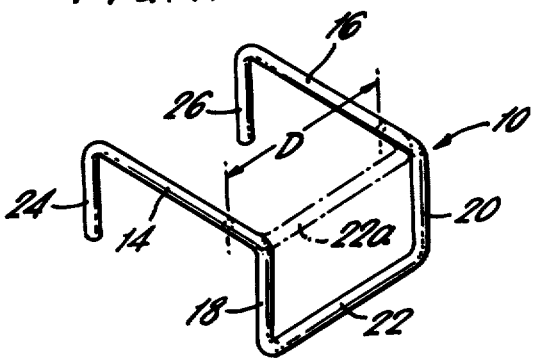
FIG. 1 is a perspective view of a bracket for use in a support assembly according to the invention.
Figure 2:
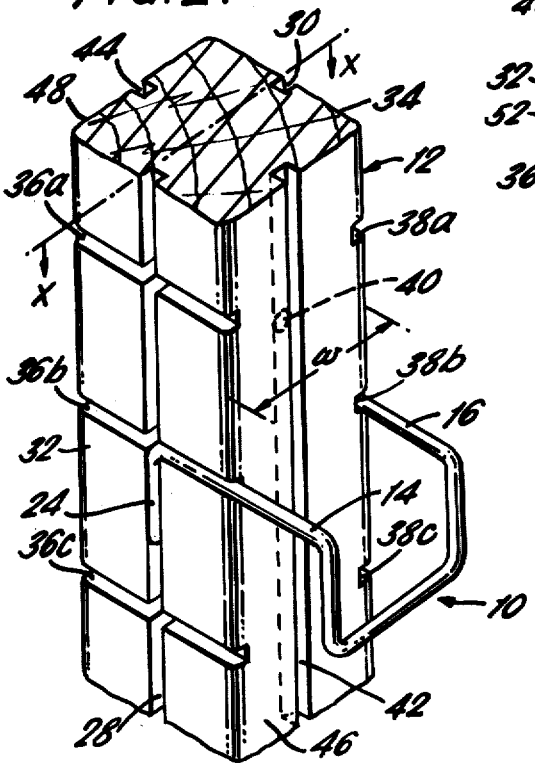
FIG. 2 is a perspective view of a support assembly, according to the invention, showing a portion of an embodiment of the elongate member.

Referring to FIGS. 1 and 2, a bracket 10 is constructed so as to be engageable in a number of different positions with an elongate support member 12.

The bracket 10 is formed from resilient steel rod and is bent so that a pair of parallel leg portions 14, 16 extend rearwardly (as seen in FIG. 1) and at right angles to respective limbs 18, 20 of an upright (as seen in FIG. 1), rectilinear U-shaped bridging portion 22. Each leg portion 14, 16 has a downwardly extending (as seen in FIG. 1) foot portion 24, 26.

Instead of a U-shaped bridging portion 22, the leg portions 14, 16 may be connected by a direct link **22*a* as shown in chain lines in FIG. 1**.

The elongate support member 12 is formed from hardwood, such as mahogany, softwood, wood substitutes, plastics material or metal and has a generally rectangular cross-section, indeed square in the case of the member shown in FIG. 2, such that the width W of the member 12 is approximately equal to the outside spacing D of the leg portions 14, 16 and foot portions 24, 26 of the bracket 10.

The elongate support member 12 has a pair of longitudinal square-section channels 28, 30 formed, for example by a routing, in a pair of opposite facets or faces 32, 34 thereof. In each of the faces 32, 34 there is also formed a series of spaced, transverse channels 36, 38, which intersect the respective longitudinal channels 28, 30. The transverse channels on each face are equally or unequally-spaced, as desired, and each transverse channel, 36*a* for example, in one of the faces 32 is opposite a respective channel 38*a* in the other face 34, and the width and depth of the channels 28, 30, 36, 38 are equal to or slightly greater than the diameter of rod from which the bracket 10 is formed.

The bracket 10 can be fitted onto the support member 12 by engaging one foot portion 26 of the bracket in the longitudinal channel 30 with the respective leg portion 16 aligned with one of the transverse channels, 38*b* for example, and by snapping the other foot portion 24 across the face 32 and into the other longitudinal channel 28, so that leg portions 14, 16 lie in the respective transverse channels 36*b*, 38*b*. The bracket 10 can be removed from the support member 12 by pulling sideways (as seen in FIG. 2) on the leg portion 14 and then rotating the bracket about the axis of the foot portion 26. The longitudinal corner edges of the member 12 are radiussed to ease removal and fitting of the bracket 10 and to alleviate the risk of grain splitting at the edges.

The resilience of the bracket is sufficient to hold the leg and foot portion 14, 16, 24, 26 in engagement with the channels 36, 38, 28, 30 but such that the leg and foot portions can be sprung apart to permit the bracket 10 to be mounted on and removed from the support member 12.

The bracket 10 may be mounted in any of the pairs of transverse channels 36, 38 of the support member 12, with the foot portions 24, 26 extending from the leg portions 14, 16, in either direction along the support member 12 and with the leg portion 14, 16 lying in those portions of the transverse channels 36, 38 to either side of longitudinal channels 28, 30. Also, more than one such brcket 10 may be mounted on the support member 12.

If the support member 12 is to be mounted against a wall, ceiling or the like and there is no requirement for brackets 10 extending on opposite sides of the member 12, a modified member 12 may be provided having the shape of that part of the member 12 shown in FIG. 2 which is to the right of the plane denoted by the line X—X, that is, a plane containing the left-hand sides of the longitudinal channels 28, 30 of the member 12 shown in FIG. 2. In that case two or more through-holes 40 are provided to receive screws for fixing the member 12 to the wall, ceiling or the like.

Figure 3:
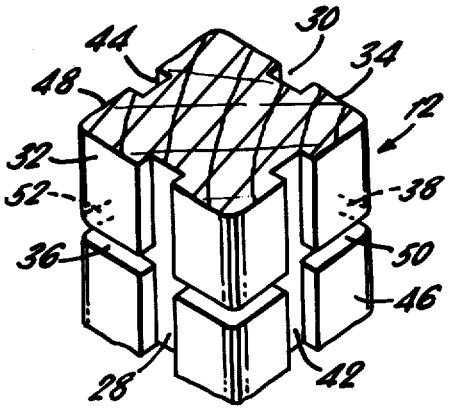
FIG. 3 is a perspective view of a portion of a modified elongate member.

The portion of the modified elongate support member 12 shown in FIG. 3 is similar in many respects to the member 12 shown in FIG. 2, and like reference numerals will be used to denote like features.

The longitudinal channels 28, 30 of the member 12 shown in FIG. 3 are approximately twice the width of the channels 28, 30 of the member 12 shown in FIG. 2 and are formed mid-way across the faces 32, 34. Furthermore, similar longitudinal channels 42, 44 are formed in the other pair of faces 46, 48 of the member 12. Also, each pair of transverse channels 36, 38 is joined by a pair of further transverse channels 50, 52 extending across the respective faces 46, 48 and intersecting the respective longitudinal channels 42, 44.

Thus, using the support member 12 shown in FIG. 3, two brackets 10 extending in opposite directions may be provided at any one position along the member 12, the foot portions 24 and 26 of one bracket lying alongside the foot portions 26 and 24, respectively, of the other bracket in the respective longitudinal channels 28, 30. Furthermore, brackets 10 may be mounted on the support member 12 with their foot portions 24, 26 lying in the other pair of longitudinal channels 42, 44 and their leg portions 14, 16 lying in the appropriate transverse channels 50, 52, thus extending at right-angles to brackets mounted further along the member 12 in the channels 28, 30, 36, 38.

Figure 4:
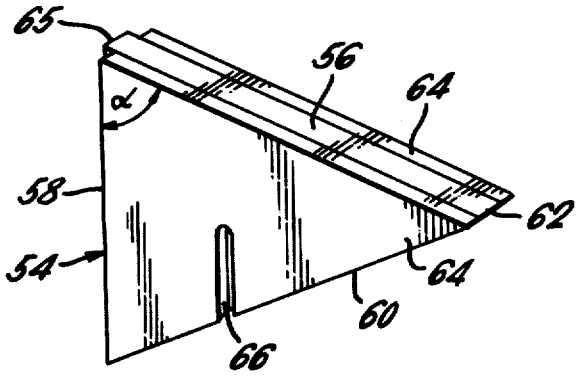
FIG. 4 is a perspective view of an extension bracket for use with the support assembly according to the invention.

The bracket extension 54 shown in FIG. 4 may be used with a bracket 10 and a support member 12 as shown in FIG. 3. The bracket extension 54 has the shape of a generally right-angled triangle having a top edge 56, a side edge 58 and a hypotenuse 60. The "right-angle" $\alpha$ can, advantageously, be slightly greater than 90°, for example 93°. The extension 54 is formed from a piece of plywood 62, having a thickness which is equal to or slightly less than the width of the longitudinal channels 28, 30, 42, 44 of the support member shown in FIG. 3. Each face of the piece of plywood 62 has a mahogany veneer 64 or thicker facing which stops short of the side edge 58 of the piece of plywood by a distance equal to the depth of the longitudinal channels 28, 30, 42, 44, to form a tongue 65.

An open-ended slot 66 extends from the hypotenuse 60 part-way across the bracket extension generally parallel to the side edge 58, the slot having a width equal to or slightly greater than the diameter of the rod from which the brackets 10 are formed. The slot 66 is spaced from the side edge 58 at such a distance that, with a bracket 10 engaged in, for example, channels 28, 30, 36, 38 of the support member 12 shown in FIG. 3, the tongue 65 can be engaged in the longitudinal channel 42 and slid along the channel so that the central bridging portion 22 of the bracket 10 is passed to the closed end of the slot 66.

Advantageously, the slot can be inclined slightly relative to the tongue in such a way that the open end of the slot is closer to the tongue than the closed end, so that, as the bridging portion is passed to the closed end of the slot, the tongue is firmly pressed into the channel 42.

If, for example, two or more spaced vertical support members 12 are provided, each having a bracket 10 and bracket extension 54 mounted thereon at the same height, such that the extensions 54 extend parallel-wise from the members 12, a shelf may be supported horizontally across the top edges 56 of the brackets extensions 54.

The bracket extension may be formed of materials, other than veneered plywood, such as metal or moulded styrene. Also the bracket extension may be shaped and ornamented as desired.

The support assembly shown in FIG. 5 includes a pair of spaced vertical support members 12, as shown in FIG. 3, each of which has a bracket 10 mounted thereon at the same height, the brackets 10 facing each other. A cross-rail 68 extends between the support members 12, each end portion of the cross-rail 68, up to and including a sot 66, being formed in a like manner to that portion of the bracket extension 54, as shown in FIG. 4, from the tongue 65 to the slot 66. The cross-rail 68 is fitted to the support members 12 by downward sliding with the tongues 65 engaged in the longitudinal channels 42 until the bridging portions 22 of the brackets 10 abut the closed ends of the slots 66 in the cross-rail 68. A notch 70 can be provided in the upper surface of the cross-rail 68 so that a further rectangular section cross-rail (not shown) can be supported between a pair of support assemblies as shown in FIG. 5, the further cross-rail being joined to the cross-rails 68 with half-lapped joints.

If the further cross rail is rigidly fixed to the cross-rails 68 of the two support assemblies, then the assembly can be free-standing.

Figure 10:
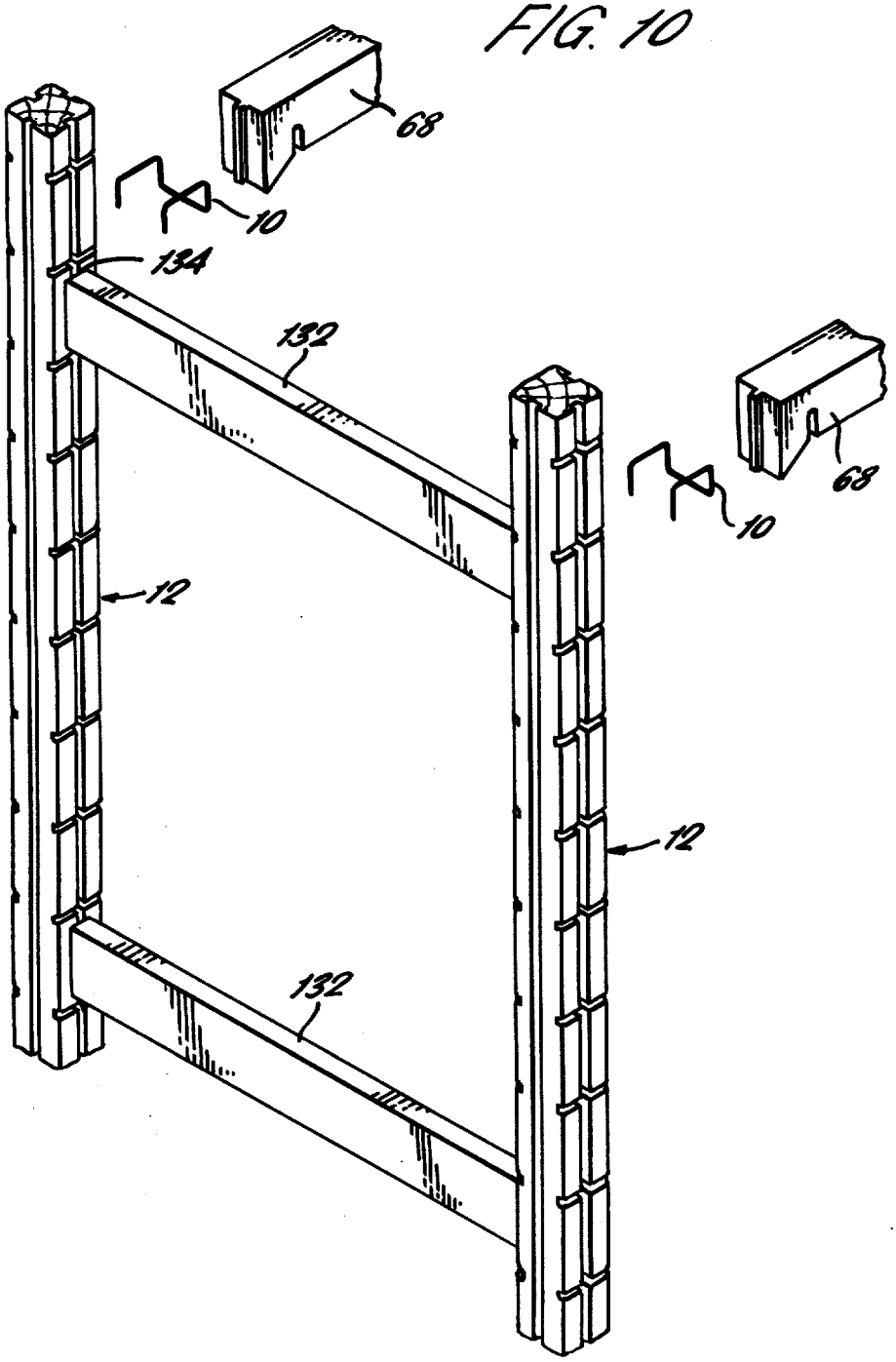
FIG. 10 is a schematic perspective view of two elongate members joined together by cross braces.

In a modified free standing assembly; a part of which is shown schematically in FIG. 10, pair of support members 12 are permanently connected together by cross-braces 132 in a ladder-like fashion, the cross-braces and members 12 being joined by mortice and tenon joints at 134. Two such pairs of members 12 are then connected together by brackets 10 and cross-rails 68 in the manner shown in FIG. 5. A shelf or table top can then be mounted on the cross-rails to form a free standing shelf or table. Further brackets, cross-rails and shelves can be added to form a tiered arrangement.

Referring to FIG. 7, a cross-rail 68, one end which is illustrated, is used to support a shelf 80 between a pair of spaced support members 12. The shelf has a cut-out 82 at each end to receive the support members 12, the shelf and cut-outs being of such dimensions that each end of the shelf extends half-way across the faces 32, 34 of the support member 12 and therefore half-way across the longitudinal channels 28, 30 in those faces. A wedge-shaped element 84 is fixed to the shelf 80 on either side of each cut-out 82 and abuts the respective face 32, 34 of the support member 12 to prevent the shelf 80 tilting. Also, each wedge-shaped element extends half-way across the respective longitudinal channel 28, 30 to lock the foot portions 24, 26 and leg portions of the bracket 10 in the respective channels.

A further bracket 10 may be provided at the same height on the support member 12 and facing in the opposite direction to support a further cross-rail 68 and shelf 80. Since the depth of the cut-outs 82 in the shelves is half the width of the support member 12, the two shelves 80 meet around the support member.

The use of a cross-rail 68 to support the shelf reduces the tendency of the shelf to sag in the middle and enables chipboard or the like to be satisfactorily used as the material for the shelf 80.

Figure 6:
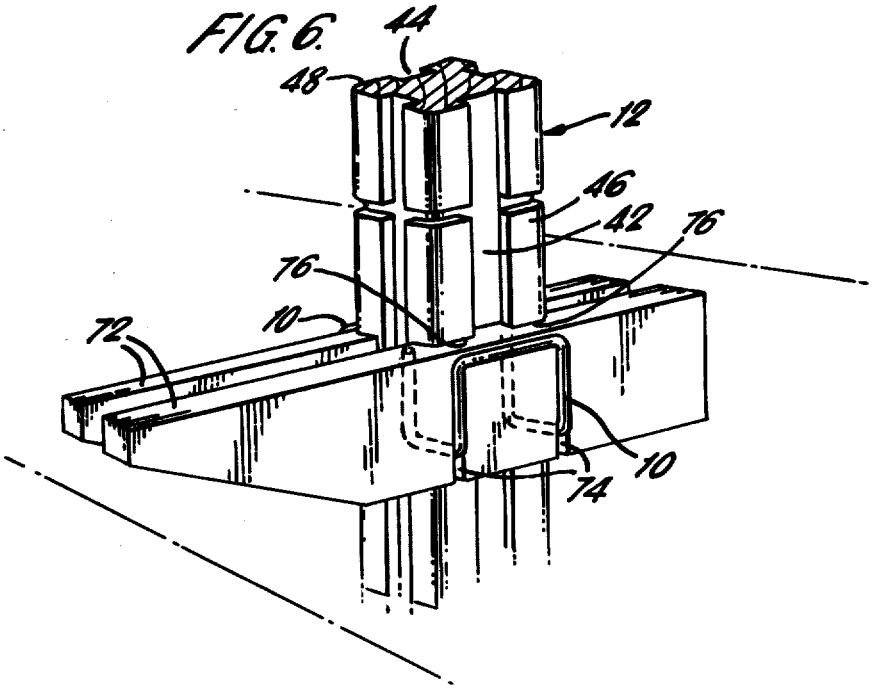
FIG. 6 is a perspective view of a support assembly, according to the invention, having a pair of extension brackets.

Referring to FIG. 6, a support member 12, as shown in FIG. 3, is provided with a pair of brackets 10 at the same level. Each bracket 10 supports a bracket extension 72 which extends to either side of the respective bracket 10. The bracket extensions 72 are provided with parallel slots 74 in the lower faces thereof to receive the leg portions 14, 16 of the brackets 10, the slots 74 serving to lock the leg and foot portions of the brackets 10 in the respective channels of the support member 12. The bracket extensions 72 are also provided with rabbets 76 to receive those portions of the side faces 48, 46 of the support member 12 to either side of the longitudinal channels 42, 44, and thus the bracket extensions 72 are prevented from twisting on the support members 12. Two or more assemblies as shown in FIG. 6 may be provided, spaced from one another, with shelves supported between the upper surfaces of pairs of bracket extensions 72. When many assemblies are provided with bracket extensions 72 at the same height, a long well-supported shelf can be formed. Also brackets 10 and bracket extensions 72 may be provided on more than one level so that a multi-level, adjustable shelving system can be built up.

Support members 12 and brackets 10 may be used for supporting cabinets, cupboards and the like and can thus form the basis of modular furniture system. Also, panels having opposite tongued edges may be fitted between a pair of support members 12, with the tongues engaged in the longitudinal channels of the support members 12, to form screening.

The brackets 10 may be used as a support attachment for light fittings and other articles. Referring to FIG. 8, the leg portions 14, 16 of the bracket 10 are joined by a part-circular portion 90 integral therewith. A bridging piece 92 is connected between the leg portions 14, 16 to stiffen the bracket. The part-circular portion may be made with a suitable diameter to receive, for example, a flower-pot tray so that a pot plant may be supported on the support member 12.

With reference to FIG. 8, the support member 12 is generally rectangular in cross-section, having radiussed corner edges. In each of the opposite faces 32, 34 two parallel longitudinal channels 28, 29; 30, 31 are formed, each transverse channel 36, 38 intersecting both of the respective longitudinal channels 28, 29; 30, 31.

Figure 9:
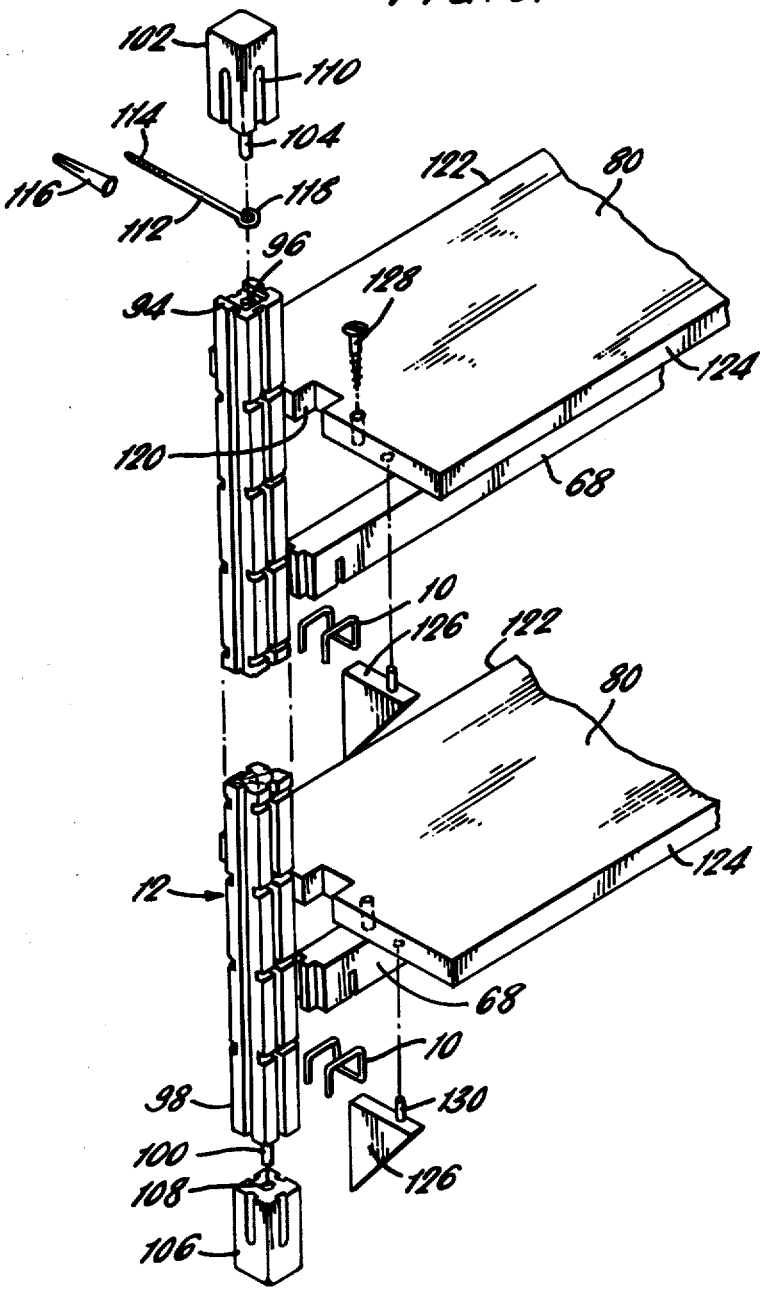
FIG. 9 is an exploded, fragmentary perspective view of a support assembly according to the invention, including foot and capping members and a wall tie.

Referring to FIG. 9, there is shown an exploded fragmentary view of part of a shelving system utilising a support 12 and bracket 10 of the type shown in FIGS. 1 and 2. However, the upper face 94 of the support 12 is provided with an axially extending hole 96 and the lower end 98 is provided with an axially extending spigot 100. A capping member 102 of a similar cross-section to the support 12 has a downwardly extending spigot 104 which fits into the hole 96 to secure the capping member 102 to the top of the support 12. A foot member 106, also of similar cross-section to the support 12 has hole 108 in its top face into which the spigot 100 of the support 12 is fitted. Both the capping member 102 and the foot member 106 are formed with channels 110 which match the longitudinal channels in the support 12. As shown the channels 110 stop short of the top of the capping member 102 and the bottom of the foot member 106, but they can continue to the outer ends of the members 102 and 106.

If it is desired to tie the support to, for example, a wall, a tie element 112 is used. The tie element is formed as a pin having a wood-screw type thread 114 at one end which can be screwed into a wall, using a wall plug 116 if required. The other end of the pin has an eye 118 of such a size that the dowel 104 of the capping member 102 is a snug fit through the eye 118, the dowel then passing into the hole 96 in the support 12. The hole 96 may be counterbored with a groove 118 being formed from the counterbore to the edge of the support 12 so that the eye 118 lies below the face 94 to hide the eye of the tie element 112 when the capping member 102 is fitted.

The foot member 106 may be similarly counterbored and grooved to receive a further tie element for tying the bottom of the support 12 to the wall.

Two such supports 12 can be fitted end-to-end with spigot 100 of one of the supports fitted into the hole 96 in the other member.

A shelving system can be formed in a similar manner to that described with reference to FIG. 7, with two tie elements 112 being used to hold the spaced supports 12 spaced from a wall.

There is also shown in FIG. 9 a modification to the type of shelf shown in FIG. 7. The cut-out 120 to receive the support 12 is located nearer to the edge 122 of the shelf 80 intended to face the wall than to the front edge 124 of the shelf. Only one triangular element 126 is used at each end of each shelf, rather than the two wedge-shaped elements 84 shown in FIG. 7, the element 126 extending from the cut-out 120 towards the front edge 124 of the shelf. The elements 126 are secured below the shelves by screws 128, dowels 130, glue, or a combination of such means.

What is claimed is:

1. A support assembly comprising an elongate member, the elongate member having at least one pair of opposed longitudinal facets, a longitudinal channel extending along at least one of said pair of facets of the elongate member and one or more transverse channels extending across that facet and intersecting the longitudinal channel, and a bracket, the bracket comprising an angled portion engageable in the longitudinal channel and the or any one of the transverse channels at an intersection, a further portion engageable with the other facet of said pair and a bridging portion joining the angled portion and the further portion to hold the angled portion in engagement with the longitudinal channel and that transverse channel, the bridging portion being spaced from the elongate member so that other members can be supported on the bridging portion and held between the bridging portion and the elongate member.

2. An assembly as claimed in claim 1, wherein the elongate member has a further longitudinal facet, a further longitudinal channel spaced from said first-mentioned longitudinal channel and extending along the other facet of the opposed pair and one or more transverse channels extending across said other facet and intersecting the further longitudinal channel, the portion of the bracket engaging said other facet comprising a further angled portion and the arrangement being such that the further angled portion is engageable in the further longitudinal channel and the or one of the respective transverse channels.

3. An assembly as claimed in claim 2, wherein the pair of opposed facets are generally parallel.

4. An assembly as claimed in claim 3, wherein each longitudinal channel is disposed part-way across the respective facet.

5. An assembly as claimed in claim 3, wherein each longitudinal channel is disposed along one edge of the respective facet.

6. An assembly as claimed in claim 3, wherein the elongate member has a second pair of generally parallel, longitudinal facets, and a second pair of longitudinal channels each formed in a respective one of said second pair of longitudinal facets.

7. An assembly as claimed in claim 6, wherein each of the second pair of longitudinal channels is intersected by one or more transverse channels.

8. An assembly as claimed in claim 6, wherein the elongate member has a generally rectangular cross-section, each pair of facets being provided by a pair of parallel faces of the elongate member.

9. An assembly as claimed in claim 8, wherein said cross-section is generally square.

10. An assembly as claimed in claim 8, wherein the elongate member has rounded longitudinal edges.

11. An assembly as claimed in claim 8, wherein the or each transverse channel in one of the faces of the elongate member is associated with the or one of the transverse channels in each of the other three faces to form a continuous channel extending around the elongate member.

12. A support assembly comprising an elongate member, the elongate member having at least one pair of opposed longitudinal facets, a longitudinal channel extending along at least one of said pair of facets of the elongate member and one or more transverse channels extending across that facet and intersecting the longitudinal channel generally at right angles, and a bracket, the bracket comprising an L-shaped angled portion engageable in the longitudinal channel and the or any one of the transverse channels at an intersection, a further portion engageable with the other facet of said pair and a bridging portion joining the angled portion and the further portion to hold the angled portion in engagement with the longitudinal channel and that transverse channel, the bridging portion being spaced from the elongate member so that other members can be supported on the bridging portion and held between the bridging portion and the elongate member.

13. An assembly as claimed in claim 12, wherein the longitudinal channel is intersected by a plurality of spaced transverse channels to enable the position of the bracket along the elongate member to be adjusted.

14. An assembly as claimed in claim 12, wherein the width of the longitudinal channel is substantially equal to either the width of or twice the width of that portion of the angled portion which is engageable therewith.

15. An assembly as claimed in claim 12, wherein the elongate member has a further longitudinal channel which is parallel to the first-mentioned longitudinal channel and which extends along the same longitudinal facet and intersects the respective transverse channel or channels.

16. An assembly as claimed in claim 15, wherein the width of each of the longitudinal channels is substantially equal to the width of that portion of the angled portion which is engageable therewith.

17. An assembly as claimed in claim 12, wherein the width of at least said one transverse channel is substantially equal to the width of that portion of the angled element which is engageable therewith.

18. A support assembly comprising an elongate member, the elongate member having a pair of parallel longitudinal facets, a longitudinal channel extending along each facet of the elongate member and one or more transverse channels extending across each facet and intersecting the respective longitudinal channel, and a bracket, the bracket comprising a pair of angled portions engageable in the longitudinal channels and the or any one of the transverse channels at an intersection, and a bridging portion joining the angled portions to hold the angled portions in engagement with the respective channels, the bridging portion being spaced from the elongate member so that other members can be supported on the bridging portion and held between the bridging portion and the elongate member.

19. An assembly as claimed in claim 18, wherein the bridging portion is generally U-shaped lying in a plane generally parallel to the longitudinal channels.

20. An assembly as claimed in claim 18, wherein the bridging portion is a direct link between said angled portions.

21. An assembly as claimed in claim 18, wherein the bracket is formed from a continuous rod which is resilient so that the angled portions can be sprung apart for engagement and disengagement of the bracket with the elongate member.

22. An assembly as claimed in claim 18, wherein the bracket is provided with means for holding an article to be supported by the assembly.

23. A support assembly comprising an elongate member, the elongate member having two pairs of longitudinal facets, a longitudinal channel extending along each facet of the elongate member and one or more transverse channels extending across each facet and intersecting the respective longitudinal channel, and a bracket, the bracket comprising a pair of angled portions engageable in the longitudinal channels of one pair of longitudinal facets and the or any one of the transverse channels of said one pair of longitudinal facets at an intersection, and a bridging portion joining the angled portions to hold the angled portions in engagement with the respective channels, the bridging portion being spaced from the elongate member, and a bracket extension comprising a support member having an edge to abut one of the other pair of longitudinal facets, a tongue extending along that edge to engage in the longitudinal channel in that facet and a portion for engaging between the bridging portion of the bracket and the elongate member so that the bracket extension is supported by the bridging portion and is held between the bridging portion and the elongate member.

24. An assembly as claimed in claim 23, wherein the support member has an open-ended slot which extends generally in the same direction as the tongued edge and which receives the central portion of the bridging portion of the bracket, so that the bracket extension can be removed by sliding the tongue along the respective channel so that the bridging portion slides to the open end of and out of the slot.

25. An assembly as claimed in claim 24, wherein the slot diverges from the tongued edge as it extends into the support member to cause the bracket extension to jam against the facet in which the respective channel is provided.

26. An assembly as claimed in claim 23, further including a further bracket extension for engaging a further support assembly, the bracket extensions being bridged to form a rail between the two support assemblies.

27. An assembly as claimed in claim 23, further including a shelf supported on the bracket extension, the shelf having a cut-out which receives the elongate member and means which engage the elongate member and the bracket to prevent tilting of the shelf and to lock one or both of the angled portions in the respective channels.

28. An assembly as claimed in claim 23, wherein the angled portions extend from the elongate member to the bridging portion spaced from the elongate member, the bracket extension having a pair of parallel grooves which receive said extending portions of the angled portions to trap the angled portions of the bracket in engagement with the respective channels in the elongate member.

29. An assembly as claimed in claim 23, wherein that portion of the bracket extension engaging the elongate member has a complementary shape to the elongate member.

30. A support assembly comprising an elongate member, the elongate member having at least one pair of opposed longitudinal facets, a longitudinal channel extending along at least one of said pair of facets of the elongate member and one or more transverse channels extending across that facet and intersecting the longitudinal channel, a bracket, the bracket comprising an angled portion engageable in the longitudinal channel and the or any one of the transverse channels at an intersection, a further portion engageable with the other facet of said pair and a bridging portion joining the angled portion and the further portion to hold the angled portion in engagement with the longitudinal chanel and that transverse channel, the bridging portion being spaced from the elongate member so that other members can be supported on the bridging portion and held between the bridging portion and the elongate member, and an end member to form a capping or foot for the elongate member, the end member and one end of the elongate member being connected by a spigot provided on one of the end member and said one end of the elongate member, which spigot engages in a spigot hole provided in the other of the end member and said one end of the elongate member.

31. An assembly as claimed in claim 30 and further comprising a tie member, the tie member comprising a pin having an eye at one end through which the spigot extends and means at the other end for fixing the pin to a wall or the like surface.

32. An assembly as claimed in claim 31, wherein a recess is formed around one of the spigot and spigot-hole, the eye of the tie member lying in the recess.

33. An assembly as claimed in claim 30, wherein the elongate member has a spigot at one end thereof and a corresponding spigot-hole at the other end thereof so that the elongate member can be connected end-to-end to a further such elongate member with a spigot and spigot-hole connection.

34. A support assembly comprising an elongate member, the eongate member having at least one pair of opposed longitudinal facets, a longitudinal channel extending along at least one of said pair of facets of the elongate member and one or more transverse channels extending across that facet and intersecting the longitudinal channel, a bracket, the bracket comprising an angled portion engageable in the longitudinal channel and the or any one of the transverse channels at an intersection, a further portion engageable with the other facet of said pair and a bridging portion joining the angled portion and the further portion to hold the angled portion in engagement with the longitudinal channel and that transverse channel, the bridging portion being spaced from the elongate member so that other members can be supported on the bridging portion and held between the bridging portion and the elongate member, and a further such elongate member space apart from and parallel to the first mentioned elongate member, and a plurality of cross-braces rigidly connecting the elongate members together.

* * * * *